United States Patent [19]

Nakajima et al.

[11] 4,315,603

[45] Feb. 16, 1982

[54] FUEL INJECTION VALVE

[75] Inventors: Takashi Nakajima; Iwao Ohno, both of Higashi-Matsuyama, Japan

[73] Assignee: Diesel Kiki Co., Ltd., Tokyo, Japan

[21] Appl. No.: 121,523

[22] Filed: Feb. 14, 1980

[30] Foreign Application Priority Data

Feb. 26, 1979 [JP] Japan ..... 54-22873[U]

[51] Int. Cl.[3] ..... B05B 1/32

[52] U.S. Cl. ..... 239/533.3; 239/533.9

[58] Field of Search ..... 239/124, 125, 533.2-533.12, 239/487-489

[56] References Cited

U.S. PATENT DOCUMENTS 3,042,313 7/1962 Packard ..... 239/488 X 3,398,936 8/1968 Delano ..... 239/533.6 X 3,885,743 5/1975 Wake ..... 239/488 X 4,195,783 4/1980 Hulsing ..... 239/533.3

*Primary Examiner*—Robert B. Reeves

*Assistant Examiner*—Gene A. Church

*Attorney, Agent, or Firm*—Frishauf, Holtz, Goodman & Woodward

[57] ABSTRACT

A fuel injection valve wherein a threaded member is threadedly mounted in a nozzle holder casing assembly for displacement therein to adjust the setting force of a valve-opening pressure setting spring and a bolt member is provided for coupling a leakage fuel drain pipe to the casing assembly. Continuous gaps are formed between the threaded peripheral surfaces of the adjusting threaded member and the coupling bolt member and the associated threaded inner peripheral surfaces of the casing assembly, which serve as leakage fuel passages.

4 Claims, 6 Drawing Figures

FUEL INJECTION VALVE

FIELD OF THE INVENTION

This invention relates to improvements in a fuel injection valve for injecting fuel into a combustion chamber of an internal combustion engine such as a Diesel engine.

DESCRIPTION OF THE PRIOR ART

In Diesel engines in general, fuel injection valves are used which are of the type comprising an injection nozzle and a nozzle holder. Such fuel injection valves are arranged at the terminal of the fuel injection system of an internal combustion engine for injecting fuel into the engine combustion chambers.

These injection valves each include an adjusting threaded member threadedly mounted in a nozzle holder casing for displacement therein to adjust the setting force of a spring urging the needle valve against its valve seat. Further threadedly mounted on the rear end of the nozzle holder casing via a cap nut or a like member is a bolt member (e.g., eyebolt) for coupling a leakage fuel drain pipe to the nozzle holder casing. The adjusting threaded member and the coupling bolt member are both formed therein with axial holes defining passages for leakage fuel present in the nozzle holder casing. However, it is very hard to accurately make such holes in these members with a twist drill or the like, involving problems of breakage of the drill bit, lengthy boring operation, etc. This causes an increase in the manufacturing cost.

OBJECT AND SUMMARY OF THE INVENTION

It is the object of the invention to provide a fuel injection valve for internal combustion engines, in which leakage fuel passages are formed between the threaded peripheral surfaces of the adjusting threaded member and the drain pipe coupling bolt member and the associated threaded inner peripheral surfaces of the nozzle holder casing assembly, to thereby dispense with the operation of making axial holes in these members as leakage fuel passages and consequently reduce the manufacturing cost.

According to one embodiment of the invention, the adjusting threaded member and the coupling bolt member each have a threaded peripheral surface thereof formed therein with at least one helical groove which extends in a direction opposite to the direction of formation of the screw thread on the same thread peripheral surface. The helical groove has a bottom face thereof lying more radially inward than the root or bottom face of the screw thread.

According to a further embodiment of the invention, either the screw threads on the threaded peripheral surfaces of the adjusting threaded member and the drain pipe coupling bolt member or those on the threaded inner peripheral surfaces of the nozzle holder casing assembly engaged with the threaded peripheral surfaces of the threaded members have substantially flat crest or top faces presenting a trapezoidal section to provide continuous gaps between the screw threads having substantially flat top faces and the bottom faces of the opposed screw threads engaged therewith.

DETAILED DESCRIPTION

Figure 1:
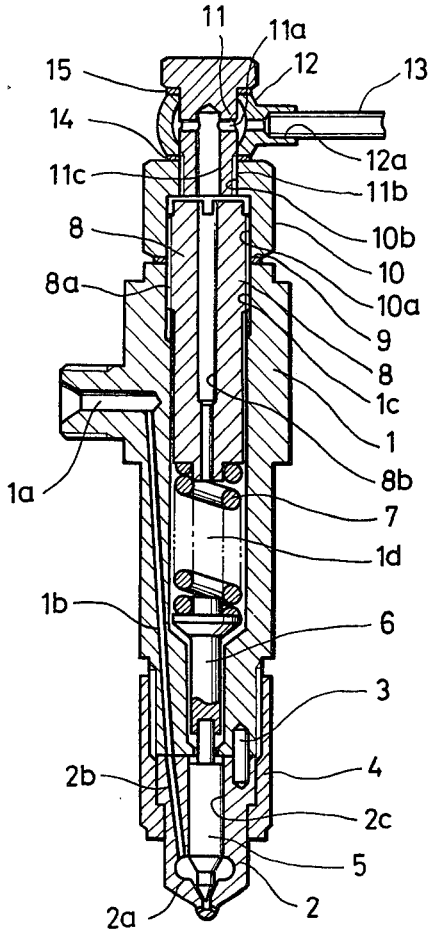
FIG. 1 (PRIOR ART)
FIG. 1 is a longitudinal sectional view of a conventional fuel injection valve.

Referring first to FIG. 1, there is shown a typical conventional fuel injection valve of this kind. Reference numeral 1 designates a casing which constitutes a nozzle holder body, on a front end of which is mounted a valve seat 2 which constitutes an injection nozzle body. The valve seat 2 is positioned in place by means of a dowel pin 3 and supported by a support shell 4 threadedly mounted on the casing 1. Slidably placed in the valve seat 2 is a needle valve 5 to a rear end of which is secured a spring seat 6 which carries a compression spring 7 seated thereon. A pipe connecting port **1*a* is formed in a lateral wall of the casing 1 to which a fuel supply pipe, not shown, is to be connected, which pipe is coupled to an injection pump, not shown either. A fuel supply passage 1*b*, 2*b* extends from the pipe connecting port 1*a* through the lateral walls of the casing 1 and the valve seat 2 and opens in a fuel chamber 2*a* formed in the valve seat 2**.

The rear end of the casing 1 is open which has a threaded inner peripheral surface **1*c*. A spring-adjusting screw 8 which has a threaded end peripheral surface 8*a* is rotatably or displaceably inserted in the casing 1 through the open rear end thereof with its threaded end peripheral surface 8*a* engaged with the threaded inner peripheral surface 1*c* of the casing 1 in a manner that its front end face urges the spring 7 toward the needle valve 5. When this adjusting screw 8 is rotated, it is axially displaced to cause a change in the setting force of the compression spring 7 to thus adjust the opening pressure of the needle valve 5. The threaded end portion 8*a* of the adjusting screw 8 partially projects rearwardly outwardly of the open rear end of the casing 1. A cap nut 10 is threadedly mounted on the projecting end of the adjusting screw 8 at its skirt threaded inner peripheral surface 10*a* via a packing 9. The casing 1 and the cap nut 10 constitute a casing assembly. The cap nut 10 has a central end face thereof formed therein with an opening 10*b* having a threaded inner peripheral surface in which an eyebolt 11 is engaged at its threaded peripheral surface 11*b*. Fitted on the eyebolt 11 is a tubular coupling member 12 which has a pipe connecting mouth 12*a* formed on its lateral wall and receiving a drain pipe 13 force fitted therein. Packings 14 and 15 are interposed between the coupling member 12 and the upper surface of the cap nut 10 and between the coupling member 12 and the head of the eyebolt 11, respectively, to maintain liquidtightness between them. A through hole 8***b* is axially centrally bored through the adjusting screw 8, while the eyebolt 11 has radial through holes 11*a* formed through its lateral wall as well as a blind hole 11*c* extending therein from its front end face and communicating with the radial through holes 11*a*.

Under this arrangement, during operation the needle valve 5 is axially reciprocably moved in a sliding bore 2*c* formed in the valve seat 2 by fuel pressure produced in the chamber 2*a* in the valve seat 2. On this occasion, part of fuel present in a very small gap between the needle valve 5 and the inner wall of the sliding hole 2*c* for lubrication thereof leaks out rearwardly of the needle valve 5 from the gap and fills a gap defined between the inner wall of the casing 1 and the spring seat 6 as well as the spring-accommodated chamber 14. The leakage fuel further travels in the central through bore 8*b* of the adjusting screw 8, the blind bore 11*c* and lateral bores 11*a* of the eyebolt 11, the lateral bore 12*a* of the coupling member 12 and the drain pipe 13, and is then returned into a fuel tank, not shown.

As is noted above, the adjusting screw 8 and the eyebolt 11 include the bores 8*b*, 11*c* and 11*a* forming leakage fuel passages. Usually, boring of these bores is carried out with a twist drill. However, this boring operation is rather hard to perform. Particularly, the adjusting screw 8 is long in size and slender, thus making it necessary to bore a considerably long and narrow hole therein to form the fuel passage bore 8*b*. It is, however, very difficult to accurately bore such hole, requiring a long machining time. Further, the drill blade may often be damaged, causing an increase in the manufacturing cost. Further, to cope with the anti-exhaust control for automobile exhaust gas as one of the anti-pollution measures lately called for, engines have recently been developed which are adapted to be supplied with fuel at high pressures and at high injection rates. To improve the responsiveness of the needle valve of the injection nozzle for adaptation to such up-to-date engines, the mass of the moving parts of the nozzle holder should be minimized. Thus, the needle valve 5, the spring seat 6 and the spring 7 which constitute the moving parts of the nozzle holder have generally been reduced in size, while the adjusting screw 8 which is a stationary part has generally been designed the larger in length, which makes more difficult the aforementioned boring operation.

Figure 2:
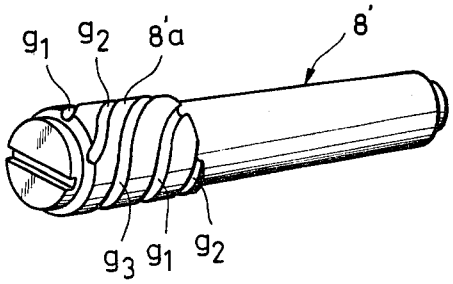
FIG. 2 is a perspective view of a semi-finished material to be wrought into an adjusting threaded member for use in the fuel injection valve according to a first embodiment of the invention.
Figure 3:
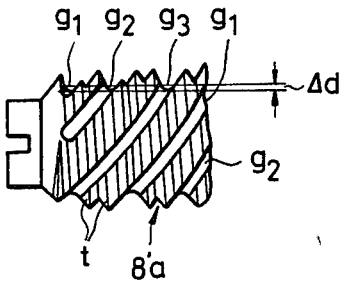
FIG. 3 is a longitudinal sectional fragmentary view of an adjusting threaded member obtained by cutting a usual screw thread in the semi-finished material of FIG. 2.
Figure 4:
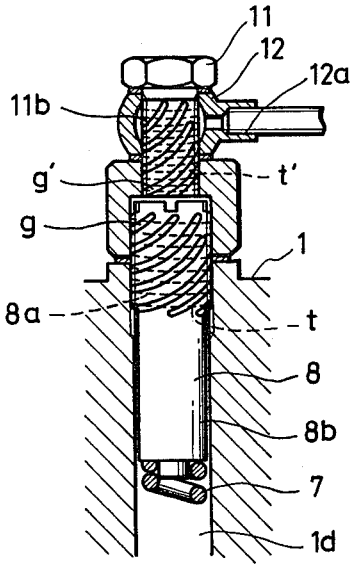
FIG. 4 is a longitudinal sectional schematic fragmentary view of the fuel injection valve according to the first embodiment of the invention.

The present invention has been made in order to solve the aforementioned problem on the machining of the fuel injection valve. Preferred embodiments of the invention will be described with reference to FIGS. 2 through 5 wherein like reference characters designate parts corresponding to those in FIG. 1. FIGS. 2 through 4 illustrate a fuel injection valve according to a first embodiment of the invention, in which FIG. 2 shows a semi-finished material 8' to be wrought into the adjusting screw 8 of the fuel injection valve. This semi-finished material 8' remains to have its peripheral surface 8'*a* threaded for threaded engagement within the valve casing of the injection valve as shown in FIG. 1. The semi-finished material 8' has a configuration identical with that of the conventional adjusting screw 8 shown in FIG. 1, but it is not formed therein with a central through bore 8*b* which conventionally would form part of the leakage fuel passage. According to the invention, as shown in the drawing, helical grooves $g_1$, $g_2$, $g_3$ are formed by rolling or like means in the peripheral surface 8'*a* in a direction opposite or reverse to the direction of formation of a crew thread to be formed therein later. These helical grooves are intended to form leakage fuel passages, thus dispensing with the formation of the central through bore 8*b*.

FIG. 3 illustrates the peripheral surface 8'*a* of the member 8' having helical grooves $g_1$, $g_2$, $g_3$ as mentioned above which is further formed therein with a screw thread t by means of rolling. As is noted form the drawing, the helical grooves $g_1$, $g_2$, $g_3$ have their bottom faces lying more radially inward than the bottom face of the screw thread t by a predetermined amount $\Delta d$ so that when the adjusting screw 8 is in threaded engagement within the casing 1 with its rear end threadedly engaged by the cap nut 10, continuous gaps are formed as leakage fuel passages between the bottom faces of the helical grooves $g_1$, $g_2$, $g_3$ in the threaded peripheral surface 8'*a* and the threaded inner peripheral walls 1*c* and 10*a* of the casing 1 and the cap nut 10. If the screw thread t is formed after the helical grooves $g_1$, $g_2$, $g_3$ have been formed, the screw t can have a helical ridge which is not out of shape. Although three helical grooves are formed in the illustrated example, such grooves may be formed in any desired number in relation to the desired width, depth and pitch thereof.

Further, according to the invention, as shown in FIG. 4, in addition to those in the adjusting screw 8, further similar helical grooves g' are formed in the threaded peripheral surface 11*b* of the eyebolt 11 which is mounted adjacent the rear end of the adjusting screw 8. Naturally the boring operation is unnecessary for forming holes such as the lateral holes 11*a* and the axial hole 11*c* shown in FIG. 1 by providing the helical grooves g' in the eyebolt 11.

FIG. 4 illustrates a fuel injection valve incorporating the adjusting screw 8 and the eyebolt 11 having such helically grooved peripheral surfaces. In this drawing, the usual screw threads t, t' are indicated in dotted lines to show distinctly the helical grooves g, g'. As is seen in FIG. 4, relatively many helical grooves g, g' are formed in the adjusting screw 8 and the eyebolt 11, respectively. Each of the helical grooves has opposite ends thereof located axially outwardly of the respective ends of the screw thread t or t' to ensure that leakage fuel passages continuously extend over the members 8 and 11 when the members 8, 11 are mounted in the fuel injection valve.

With this arrangement, leakage fuel which fills the chamber 1*d* accommodating the compression spring 7 is guided into the helical grooves g in the adjusting screw 8 through the gap between the outer peripheral surface of the lower half portion 8*b* of the adjusting screw 8 having a relatively smaller diameter and the inner peripheral wall of the casing 1 and then travels in the helical grooves g' in the eyebolt 11 to be guided through the lateral hole 12*a* of the coupling member 12 into the drain pipe 13 and returned into a fuel tank, not shown.

Figure 5:
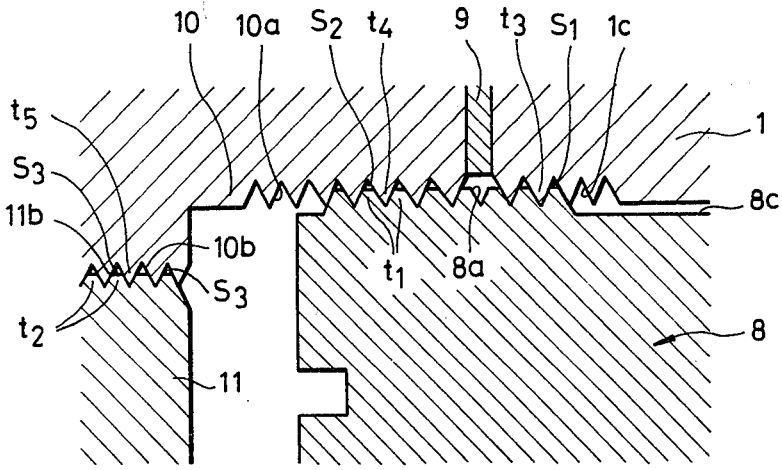
FIG. 5 is a longitudinal sectional fragmentary view of the fuel injection valve according to a second embodiment of the invention.

A second embodiment of the invention will be described with reference to FIG. 5. FIG. 5 illustrates in section on an enlarged scale a portion of a fuel injection valve according to the invention where the adjusting screw 8 and the cap nut 10 are in threaded engagement with each other. Like the arrangement shown in FIGS. 1–4, the adjusting screw 8 has its threaded peripheral surface 8*a* threadedly engaged by both the threaded inner peripheral wall 1*c* of the nozzle holder casing 1 and the threaded inner peripheral wall 10*a* of the skirt portion of the cap 10. Further, the eyebolt 11 has its end portion formed with a threaded peripheral surface 11*b* which is threadedly engaged within the central tapped hole 10*b* of the cap nut 10. It is noted that the screw threads $t_1$, $t_2$ on the threaded peripheral surfaces 8*a* and 11*b* of the adjusting screw 8 and the eyebolt 11 have their crest faces formed substantially flat to present a trapezoidal section. Substantially triangular gaps $s_1$, $s_2$, $s_3$ are continuously formed between the crest faces of these trapezoidal screw threads $t_1$, $t_2$ and the bottom faces of the screw threads $t_3$, $t_4$, $t_5$ of the threaded inner peripheral walls 1*c*, 10*a*, 10*b* of the casing 1 and the cap nut 10.

These substantially triangular void spaces $s_1$, $s_2$, $s_3$ provide a helical leakage fuel passage over the threaded peripheral surfaces 8*a* and 11*b*. Therefore, the adjusting screw 8 and the eyebolt 11 according to the second embodiment of the invention have no leakage fuel passage holes formed therein such as the holes 8*b* and 11*c* shown in FIG. 1.

In the fuel injection valve in which the adjusting screw 8 and the eyebolt 11 having their peripheral surfaces thus formed with the above-mentioned screw threads are incorporated, leakage fuel in the compression spring-accommodated chamber 1*d* travels in the gap between the peripheral surface of the smaller-diameter lower half portion 8*c* of the adjusting screw 8 and the inner peripheral wall of the casing 1 into the triangular voids $s_1$, $s_2$ on the threaded peripheral surface $8_a$ of the screw 8. Then, it is guided through the triangular voids $s_3$ formed around the threaded peripheral surface 11*b* of the eyebolt 11 to be delivered into the fuel tank, not shown, via the lateral hole 12*a* of the coupling member 12 and the drain pipe 13 as shown in FIG. 1.

Figure 6:
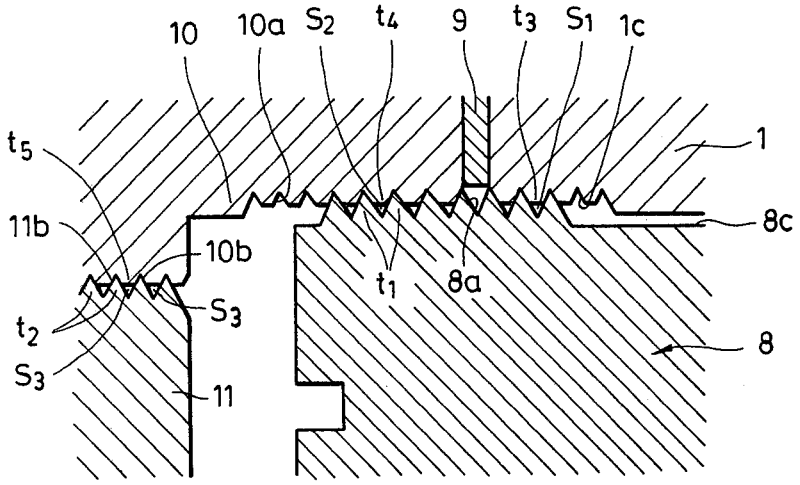
FIG. 6 is a similar view to FIG. 5 but showing a further embodiment of the invention.

Although in the above-stated second embodiment the screw threads on the threaded peripheral surfaces 8*a*, 11*b* of the adjusting screw 8 and the eyebolt 11 are trapezoidally configurated, the screw threads $t_3$, $t_4$, $t_5$ on the opposed threaded inner walls 1*c*, 10*a*, 10*b* of the casing 1 and the cap nut 10 engaged therewith may be formed trapezoidally instead, as illustrated in FIG. 6.

Further, the nozzle holder casing 1 and the cap nut 10 may be formed integrally with each other in a fashion that the central threaded bore 10*b* of the cap nut 10 has an inner diameter equal to or larger than the diameter of the threaded portion of the casing 1 for allowing mounting of the adjusting screw 8 into the casing 1 through the tapped bore 10*b*.

It is to be understood that the foregoing description relates to preferred embodiments of the invention and that various changes and modifications may be made in the invention without departing from the spirit and scope thereof.

What is claimed is:

1. In a fuel injection valve including a needle valve, a nozzle body in which said needle valve is seated, a casing assembly holding said needle valve and said nozzle body and leakage fuel drain pipe means coupled to said casing assembly, the improvement comprising a combination of:

a spring accommodated in said casing assembly and urging said needle valve against said nozzle body;

an adjusting threaded member having two ends, said adjusting threaded member being displaceably mounted in said casing assembly and urging at one end thereof said spring for adjustment of the setting force thereof through displacement thereof; and a coupling threaded member engaged with said casing assembly and having two ends, one end thereof being arranged adjacent the other end of said adjusting threaded member, said coupling threaded member being adapted to connect said leakage fuel drain pipe means to said casing assembly;

said casing assembly having a threaded inner peripheral surface, and said adjusting threaded member and said coupling threaded member each having an outer peripheral surfcace thereof which is threaded and which is threadably engaged by said threaded inner peripheral surface of said casing assembly, said threaded outer peripheral surfaces of said adjusting threaded member and said coupling threaded member and said threaded inner peripheral surface of said casing assembly being configurated such that continuous gaps are formed therebetween to act as leakage fuel passages;

said adjusting threaded member and said coupling threaded member each have said threaded outer peripheral surface thereof formed therein with at least one helical groove extending a direction opposite to the direction of formation of a screw thread formed on the same threaded peripheral surface, said helical groove having a bottom face lying more radially inward than the bottom face of said screw thread, said helical grooves comprising said continuous gaps.

2. In a fuel injection valve including a needle valve, a nozzle body in which said needle valve is seated, a casing assembly holding said needle valve and said nozzle body and leakage fuel drain pipe means coupled to said casing assembly, the improvement comprising a combination of:

a spring accommodated in said casing assembly and urging said needle valve against said nozzle body;

an adjusting threaded member having two ends, said adjusting threaded member being displaceably mounted in said casing assembly and urging at one end thereof said spring for adjustment of the setting force thereof through displacement thereof; and a coupling threaded member engaged with said casing assembly and having two ends, one end thereof being arranged adjacent the other end of said adjusting threaded member, said coupling threaded member being adapted to connect said leakage fuel drain pipe means to said casing assembly;

said casing assembly having a threaded inner peripheral surface, and said adjusting threaded member and said coupling threaded member each having an outer peripheral surfcace thereof which is threaded and which is threadably engaged by said threaded inner peripheral surface of said casing assembly, said threaded outer peripheral surfaces of said adjusting threaded member and said coupling threaded member and said threaded inner peripheral surface of said casing assembly being configurated such that continuous gaps are formed therebetween to act as leakage fuel passages;

said threaded outer peripheral surfaces of said adjusting threaded member and of said coupling threaded member each have a screw thread having a substantially flat crest face, and wherein a continuous void is provided between said substantially flat crest faces of said screw threads of said adjusting and coupling threaded members and the bottom face of said screw thread formed on the threaded inner peripheral surface of said casing assembly engaged with said threaded peripheral surfaces of said adjusting and coupling threaded members, said continuous void comprising said continuous gaps.

3. In a fuel injection valve including a needle valve, a nozzle body in which said needle valve is seated, a casing assembly holding said needle valve and said nozzle body and leakage fuel drain pipe means coupled to said casing assembly, the improvement comprising a combination of:

a spring accommodated in said casing assembly and urging said needle valve against said nozzle body;

an adjusting threaded member having two ends, said adjusting threaded member being displaceably mounted in said casing assembly and urging at one end thereof said spring for adjustment of the setting force thereof through displacement thereof; and a coupling threaded member engaged with said casing assembly and having two ends, one end thereof being arranged adjacent the other end of said adjusting threaded member, said coupling threaded member being adapted to connect said leakage fuel drain pipe means to said casing assembly;

said casing assembly having a threaded inner peripheral surface, and said adjusting threaded member and said coupling threaded member each having an outer peripheral surfcace thereof which is threaded and which is threadably engaged by said threaded inner peripheral surface of said casing assembly, said threaded outer peripheral surfaces of said adjusting threaded member and said coupling threaded member and said threaded inner peripheral surface of said casing assembly being configurated such that continuous gaps are formed therebetween to act as leakage fuel passages;

said threaded inner peripheral surface of said casing assembly has a screw thread having a substantially flat crest face, and wherein a continuous void is provided between said substantially flat crest face of said screw thread of said threaded inner peripheral surface and the bottom face of a screw thread formed on the threaded outer peripheral surface of each of said adjusting and coupling threaded members engaged with said threaded inner peripheral surface of said casing assembly, said continuous void comprising said continuous gaps.

4. The fuel injection valve of any one of claims 1-3 wherein:

said casing assembly comprises a nozzle holder casing and a cap-like hollow member each of which has a threaded inner peripheral surface, said cap-like hollow member having an end face and a skirt portion extending from the end face;

said one end of said adjusting threaded member being threadably engaged with said nozzle holder casing and said other end thereof projecting rearwardly of one end of said nozzle holder casing, said projecting other end of said adjusting threaded member being threadedly engaged with said skirt portion of said cap-like hollow member;

said cap-like hollow member having a central tapped hole formed in the end face thereof; and said coupling threaded member being threadedly engaged in said central tapped hole in said end face of said cap-like hollow member.

* * * * *